US007160048B1

(12) United States Patent
Fattori et al.

(10) Patent No.: US 7,160,048 B1
(45) Date of Patent: Jan. 9, 2007

(54) FLOW RESTRICTING MEMBER

(75) Inventors: James G. Fattori, Trevose, PA (US); Kenneth E. Brown, Plainsboro, NJ (US); George Lesenskyj, Robbinsville, NJ (US); Christopher M. Budzinski, Lawrenceville, NJ (US)

(73) Assignee: LMT Mercer Group Inc., Lawrenceville, NJ (US)

( * ) Notice: Subject to any disclaimer, the term of this patent is extended or adjusted under 35 U.S.C. 154(b) by 0 days.

(21) Appl. No.: 11/156,844

(22) Filed: Jun. 20, 2005

(51) Int. Cl.
*E01C 11/22* (2006.01)

(52) U.S. Cl. ..... 404/4; 404/2

(58) Field of Classification Search ..... 405/36, 405/43–45; 407/2–5
See application file for complete search history.

(56) References Cited

U.S. PATENT DOCUMENTS

| | | | | |
|---|---|---|---|---|
| 232,948 | A | 10/1880 | Devnham | |
| 374,393 | A | 12/1887 | Campbell | |
| 440,067 | A | 11/1890 | Smith | |
| 468,714 | A | 2/1892 | Whitten | |
| 505,130 | A | 9/1893 | Ryan | |
| 506,267 | A | 10/1893 | Sefton | |
| 642,530 | A | 1/1900 | Robertson | |
| 672,868 | A | 4/1901 | Banwell | |
| 693,511 | A | 2/1902 | Garrett et al. | |
| 783,556 | A | 2/1905 | Buskirk | |
| 1,245,903 | A | 11/1917 | Gross | |
| 1,473,551 | A | 11/1923 | Gschwind | |
| 1,479,651 | A * | 1/1924 | Clements | 404/6 |
| 1,711,674 | A | 5/1929 | Egan | |
| 2,159,752 | A | 5/1939 | Shaw | |
| 2,473,279 | A | 6/1949 | Cracker | |
| 3,788,756 | A | 1/1974 | Ito | |
| 3,881,832 | A | 5/1975 | Maguire | |
| 3,957,383 | A | 5/1976 | Fredericks | |
| 4,046,482 | A | 9/1977 | Paasch | |
| 4,594,157 | A | 6/1986 | McGowan | |
| 4,610,566 | A | 9/1986 | Albang et al. | |
| 5,232,587 | A | 8/1993 | Hegemier et al. | |
| 5,345,741 | A | 9/1994 | Slater et al. | |
| 5,403,474 | A | 4/1995 | Emery | |
| 5,462,382 | A * | 10/1995 | Sauerwein et al. | 404/2 |
| 5,632,888 | A | 5/1997 | Chinn et al. | |
| 5,702,595 | A | 12/1997 | Mossburg, Jr. | |
| 5,954,952 | A | 9/1999 | Strawser, Sr. | |
| 6,010,622 | A | 1/2000 | Chinn et al. | |
| 6,015,489 | A | 1/2000 | Allen et al. | |
| 6,017,166 | A | 1/2000 | Mossburg, Jr. | |
| 6,214,216 | B1 | 4/2001 | Isaacson | |
| 6,227,758 | B1 | 5/2001 | Missick et al. | |
| 6,379,078 | B1 * | 4/2002 | Zwier | 404/7 |
| 6,402,942 | B1 | 6/2002 | Cardwell et al. | |
| 6,537,446 | B1 | 3/2003 | Sanguinetti | |

(Continued)

*Primary Examiner*—Frederick L. Lagman
(74) *Attorney, Agent, or Firm*—Sperry, Zoda & Kane

(57) ABSTRACT

A device for restricting the flow through a curb inlet opening of a street storm drain by positioning a face plate thereover with a plurality of flow apertures therethrough of limited size. The face plate is securable to the drain by a mounting apparatus including one or more mounting brackets along with an engagement device for securing the mounting brackets with respect to the drain and the face plate for mounting the face plate extending over the curb inlet opening. Mounting brackets include alternatively teeth for engaging mated teeth on the rear of the face plate and storm drain engaging teeth also. Edges of the face plate can be chamfered for protection and a protective rim can extend upwardly around the securement apertures for protection thereof.

25 Claims, 8 Drawing Sheets

U.S. PATENT DOCUMENTS 6,609,852 B1 8/2003 Wimberger
6,709,579 B1 3/2004 Singleton et al.
6,811,708 B1 11/2004 Shaw et al.
6,821,053 B1 11/2004 Martinez
6,824,677 B1 11/2004 Martinez
6,908,256 B1 * 6/2005 Humphries et al. ..... 404/2
2004/0173513 A1 * 9/2004 Nino ..... 404/4
2005/0207839 A1 * 9/2005 Tremouilhac ..... 404/5

* cited by examiner

FLOW RESTRICTING MEMBER

BACKGROUND OF THE INVENTION

1. Field of the Invention

The present invention deals with the field of devices for restricting flow through curb inlet openings defined in street storm drains. The governmental costs for processing and cleaning water and other items that pass through curb inlet openings of street storm drains has become excessive. As such, there is a movement currently to restrict the materials that can flow into such inlet curb inlet openings by limiting the size of such openings. Often the openings are limited to a dimension of two inches or less. The present invention provides a novel construction for a face plate and mounting apparatus which together facilitates attaching of a flow restricting member in position extending over the curb inlet opening to restrict the flow of materials therein such as bottles, trash, toys and, most particularly, children and other persons. The mounting apparatus of the present invention includes a mounting bracket and an engagement means which can quickly and easily and reliably secure the face plate with respect to the street storm drain in the area thereof immediately surrounding a curb inlet opening for restricting flow and access thereinto.

2. Description of the Prior Art

Other prior art devices utilizing alternative constructions have been disclosed for the purpose of restricting access or flow into storm drains in various issued patents such as disclosed in U.S. Pat. No. 232,948 patented Oct. 5, 1880 to F. Dernham on a "Sewer"; and U.S. Pat. No. 374,393 patented Dec. 6, 1887 to G. G. Campbell on a "Catch Basin Cover"; and U.S. Pat. No. 440,067 patented Nov. 4, 1890 to R. Smith and Assignor of One-Half to George W. Strange on a "Catch-Basin Top And Trap"; and U.S. Pat. No. 468,714 patented Feb. 9, 1892 to W. M. Whitten on a "Cover For Catch Basins"; and U.S. Pat. No. 505,130 patented Sep. 19, 1893 to T. J. Ryan on a "Receiver And Stench Trap"; and U.S. Pat. No. 506,267 patented Oct. 10, 1893 to W. E. Sefton and assigned to Sherlock, Elmer & Sherlock on a "Sewer-Basin Trap"; and U.S. Pat. No. 642,530 patented Jan. 30, 1900 to G. A. Robertson on a "Catch Basin"; and U.S. Pat. No. 672,868 patented Apr. 23, 1901 to J. Banwell and assigned to C. W. Nokes and George Caunter on a "Casing And Cover For Catch-Basins"; and U.S. Pat. No. 693,511 patented Feb. 18, 1902 to W. H. Garrett & H. C. Pauly and assigned to Hennessy Foundry Company on a "Sewer-Inlet"; and U.S. Pat. No. 783,556 patented Feb. 28, 1905 to R. M. Van Buskirk on a "Catch Basin Top"; and U.S. Pat. No. 1,245,903 patented Nov. 6, 1917 to E. G. Gross on a "Sewer-Trap Cap"; and U.S. Pat. No. 1,473,551 patented Nov. 6, 1923 to L. Gschwind on a "Direct Sewer Inlet"; and U.S. Pat. No. 1,479,651 patented Jan. 1, 1924 to E. G. Clements on a "Device For Marking Parking Limits For Vehicles"; and U.S. Pat. No. 1,711,674 patented May 7, 1929 to G. F. Egan on a "Sewer Construction"; and U.S. Pat. No. 2,159,752 patented May 23, 1939 to E. W. Shaw and assigned to The France Foundry & Machine Co. on a "Curb Inlet"; and U.S. Pat. No. 2,473,279 patented Jun. 14, 1949 to De Witt S. Crocker on a "Curb Inlet Casting"; and U.S. Pat. No. 3,788,756 patented Jan. 29, 1974 to S. Ito on a "Curb And Drain Unit"; and U.S. Pat. No. 3,881,832 patented May 6, 1975 to H. A. Maguire on a "Low Profile Protective Insert For Sewers"; and U.S. Pat. No. 3,957,383 patented May 18, 1976 to R. H. Fredericks on a "Curb Protection Device And Method"; and U.S. Pat. No. 4,046,482 patented Sep. 6, 1977 to H. R. Paasch on a "Protective Cover For Sewer Grates"; and U.S. Pat. No. 4,594,157 patented Jun. 10, 1986 to B. J. McGowan on an "Inlet Clamp And Screen"; and U.S. Pat. No. 4,610,566 patented Sep. 9, 1986 to N. P. Albang et al and assigned to Phoenix Simpton Company on a "Curb Inlet With Removable Gutter Form"; and U.S. Pat. No. 5,232,587 patented Aug. 3, 1993 to T. E. Hegemier et al and assigned to Tom Hegemier on a "Stormwater Inlet Filter"; and U.S. Pat. No. 5,345,741 patented Sep. 13, 1994 to H. O. Slater et al and assigned to J. & H. Slater Construction Co., Inc. on a "Silt Blockage For Catch Basins"; and U.S. Pat. No. 5,403,474 patented Apr. 4, 1995 to G. R. Emery on a "Curb Inlet Gravel Sediment Filter"; and U.S. Pat. No. 5,632,888 patented May 27, 1997 to A. W. Chinn et al and assigned to Dandy Enterprises Limited on an "Environmental Filter"; and U.S. Pat. No. 5,702,595 patented Dec. 30, 1997 to W. H. Mossburg, Jr. on a "Catch Basin Guard"; and U.S. Pat. No. 5,954,952 patented Sep. 21, 1999 to D. M. Strawser and assigned to Alpine Stormwater Management Company on a "Stormwater Catch Basin Filter Assembly"; and U.S. Pat. No. 6,010,622 patented Jan. 4, 2000 to A. W. Chinn et al and assigned to Dandy Enterprises Limited on an "Environmental Filter"; and U.S. Pat. No. 6,015,489 patented Jan. 18, 2000 to L. J. Allen et al and assigned to Larry J. Allen and Bridgett L. Allen on a "Plastic Self-Relieving Curb Inlet Fitler"; and U.S. Pat. No. 6,017,166 patented Jan. 25, 2000 to W. H. Mossburg, Jr. on a "Catch Basin Guard And Filter"; and U.S. Pat. No. 6,214,216 patented Apr. 10, 2001 to R. Isaacson on a "Drain Filter Support"; and U.S. Pat. No. 6,227,758 patented May 8, 2001 to G. J. Missick et al on a "Protector For Through-The-Curb Drain"; and U.S. Pat. No. 6,402,942 patented Jun. 11, 2002 to T. Cardwell et al on a "Catch Basin Curb Inlet Filter Assembly"; and U.S. Pat. No. 6,537,446 patented Mar. 25, 2003 to P. S. Sanguinetti and assigned to The Water Sweeper on a "Drainage Filter System For Debris And Contaminant Removal"; and U.S. Pat. No. 6,609,852 patented Aug. 26, 2003 to B. J. Wimberger and assigned to Brian J. Wimberger on a "Sediment Control Drain And Method Of Construction"; and U.S. Pat. No. 6,709,579 patented to E. R. Singleton et al on Mar. 23, 2004 and assigned to Silt-Saver, Inc. on a "Curb Inlet Filter"; and U.S. Pat. No. 6,811,708 patented Nov. 2, 2004 to M. D. Shaw et al and assigned to UltraTech International, Inc. on a "Curb Guard Filter"; and U.S. Pat. No. 6,821,053 patented Nov. 23, 2004 to A. Martinez on a "Water Flow Responsive Barrier For Gutters And Storm Drains With Rotary Actuator"; and U.S. Pat. No. 6,824,677 patented to A. Martinez on November 330, 2004 on a "Curbside Trap For Pollutants And Solid Trash".

SUMMARY OF THE INVENTION

The flow restricting member of the present invention is designed specifically for attachment to a street storm drain such that it will extend over and restrict the flow through a curb inlet opening defined in the street storm drain. This construction includes a face plate which includes at least one but preferably a plurality of individual flow apertures defined therein. These flow apertures provide some level of limited or restricted flow through the face plate and into the curb inlet opening. The face plate will also preferably define a plurality of securement apertures to facilitate securement of the face plate with respect to the street storm drain itself. The securement apertures are shaped as slots to facilitate adjustment. Each of these flow apertures will define a first flow aperture opening in the front surface of the face plate and a second flow aperture opening in the rear surface of the face plate in flow communication with respect to one another. These flow apertures are tapered inwardly toward the rear surface of the face plate preferably such that the first flow aperture is larger than the second flow aperture to facilitate protection of the face plate by providing beveled or chamfered edges therearound. The face plate preferably includes a rear surface facing the curb inlet opening whenever the face plate is mounted. Also in the mounted position the face plate will define a front surface positioned oppositely from the rear surface facing away from the street storm drain. The face plate can also define first and second lateral ends at the lateral opposite ends which are preferably chamfered or beveled.

The flow restricting member of the present invention further includes a mounting apparatus at least partially positioned extending through the securement apertures for engagement with respect to the storm drain immediately surrounding the curb inlet opening and engageable with respect to the face plate for retaining it in position extending over the curb inlet opening for restricting flow therethrough. The mounting apparatus preferably includes at least one but preferably a plurality of mounting brackets positioned adjacent to each of the securement apertures at a position behind the rear surface of the face plate preferably. The mounting bracket will include a securement section which is spatially disposed from the rear surface of the face plate to define a retaining zone therebetween which receives and holds a street storm drain, particularly, holding the portion of the street storm drain immediately surrounding the curb inlet opening. In this manner the face plate will be fixedly secured with respect to the storm drain by proper positioning of the mounting bracket. The mounting bracket also preferably will define a threaded hole therethrough to facilitate engagement therewith. The mounting bracket will also include a first abutment surface thereon which is adapted to contact and engage a second abutment surface defined on the rear surface of the face plate. The first and second abutment surfaces are adapted to abut and engage one another to facilitate securement of the mounting bracket with respect to the rear surface of the face plate.

The mounting bracket will also preferably include a guide block extending outwardly therefrom which is positionable extending into the securement slot to facilitate maintaining of orientation of the mounting bracket with respect to the face plate. The guide block will preferably include a threaded hole defined therein. Each of the guide blocks preferably includes a first pair of guide surfaces spatially disposed from one another and extending generally parallel to one another which are adapted to orient the mounting bracket with respect to the face plate to facilitate securement to the storm drain. A second pair of guide surfaces can be also defined on the guide block for this same purpose. Preferably the second pair of guide surfaces are oriented parallel with respect to one another and extend approximately perpendicularly with respect to the first pair of guide surfaces.

The first abutment surface of the mounting bracket preferably includes engaging teeth adapted to enhance abutment of the second abutment surface therewith. These are preferably referred to as first engaging teeth. The second abutment surface preferably includes second engaging teeth thereon for engagement with the first engaging teeth for enhancing securement between the first and second abutment surfaces. The first engaging teeth and the second engaging teeth are preferably shaped in a mutually mated manner to facilitate this engagement. The securement section of the mounting bracket can also preferably include drain engaging teeth which are adapted to abut and engage a street storm drain to facilitate retaining thereof within the retaining zone defined between the rear surface of the face plate and the securement section of the mounting bracket.

An engagement device mechanism is also preferably includable which is positioned extending through each of the securement apertures to be engageable with the mounting bracket for urging thereof toward the rear surface of the face plate with the street storm drain surrounding the curb inlet opening positioned within the retaining zone for securement of the face plate with respect to it. This engagement means preferably includes a threaded stud member which is positionable extending through the securement aperture for engagement with the threaded hole to facilitate the mounting bracket in retaining the street storm drain and face plate together. Preferably the flow restricting member also includes a plurality of protective rims positioned on the front surface of the face plate in position extending outwardly therefrom. One of these protective rims are preferably positioned at least partially surrounding each of the securement apertures for protecting of the aperture and protecting of an engagement means such as a bolt or threaded member positioned therethrough. Protecting of these bolts is important because, if they are damaged, it can cause the face plate to become disengaged from the storm drain. Thus these upwardly extending protective rims achieve increased elevation to allow the threaded securement means to be countersunk thereinto. In the preferred configuration each of the protective rims includes an outer rim edge having a bevel thereon extending toward the face plate outwardly away from the engagement aperture to facilitate protection of the protective rims and thereby further facilitate protection of the engagement apparatus.

In one of the preferred configurations of the present invention the face plate will define four separate securement apertures with the outside securement apertures being slots and extending horizontally and the innermost two securement apertures being of slotted shape and extending vertically. In this manner maximum universal flexibility in securement with respect to various different sizes, shapes and configurations of street storm drains is made possible. It is particularly important that the outboard brackets be capable of various orientations and positionings in order to be capable of fitting the wide variety of castings and particularly those with openings having large radii.

In some applications it is also necessary to use a full shroud rather than merely the face plate and in those configurations an upper plate member will be secured to the face plate to extend rearwardly therefrom at an angle of approximately 90 to 120 degrees with respect thereto. In this manner the full shroud will cover not only the curb inlet opening and the street storm drain portion therearound but also the horizontal portion of the street storm drain extending rearwardly from the area adjacent the curb inlet opening thereof. Also the present invention in some applications requires a clearance space between the rear surface of the face plate and the street storm drain and curb inlet opening defined therein. For these applications one or more individual rear surface spacing members will be secured to the rear surface of the face plate to extend outwardly therefrom to in this manner define a clearance space between the street storm drain and the rear surface of the face plate wherein the face plate is properly installed and secured in position.

It is an object of the present invention to provide a flow restricting member particularly usable attached to a street storm drain for restricting flow into a curb inlet opening therein which includes flow apertures with a maximum length or width dimension of two inches.

It is an object of the present invention to provide a flow restricting member particularly usable attached to a street storm drain for restricting flow into a curb inlet opening therein which includes a mounting apparatus with an engagement means for securing a mounting bracket with respect to a face plate and the storm drain for securing them together.

It is an object of the present invention to provide a flow restricting member particularly usable attached to a street storm drain for restricting flow into a curb inlet opening therein which includes chamfered edges at various locations to minimize damage such as from snow plows or other vehicles when in use positioned over a street storm drain.

It is an object of the present invention to provide a flow restricting member particularly usable attached to a street storm drain for restricting flow into a curb inlet opening therein which includes protective rims extending outwardly for protecting the mounting apparatus for securing the face plate to the drain.

It is an object of the present invention to provide a flow restricting member particularly usable attached to a street storm drain for restricting flow into a curb inlet opening therein which has minimal capital costs.

It is an object of the present invention to provide a flow restricting member particularly usable attached to a street storm drain for restricting flow into a curb inlet opening therein which requires a minimum amount of maintenance.

It is an object of the present invention to provide a flow restricting member particularly usable attached to a street storm drain for restricting flow into a curb inlet opening therein which is lightweight.

It is an object of the present invention to provide a flow restricting member particularly usable attached to a street storm drain for restricting flow into a curb inlet opening therein which includes a unique means of attachment utilizing mounting brackets and engaging devices such as threaded studs.

It is an object of the present invention to provide a flow restricting member particularly usable attached to a street storm drain for restricting flow into a curb inlet opening therein which includes drain engaging teeth located on the mounting bracket to facilitate engagement of the mounting bracket with respect to the street storm drain itself in the area thereof immediately surrounding the curb inlet opening.

It is an object of the present invention to provide a flow restricting member particularly usable attached to a street storm drain for restricting flow into a curb inlet opening therein which can include tamperproof threaded bolts to prevent disengagement or removal thereof.

It is an object of the present invention to provide a flow restricting member particularly usable attached to a street storm drain for restricting flow into a curb inlet opening therein which includes engaging teeth on the mounting bracket designed to interlock with engaging teeth on an abutment surface defined on the rear surface of the face plate for facilitating securement of the face plate with respect to the drain.

It is an object of the present invention to provide a flow restricting member particularly usable attached to a street storm drain for restricting flow into a curb inlet opening therein which can include guide blocks with guide surfaces for maintaining proper angular orientation of the mounting bracket with respect to the securement slot within which it is positioned.

It is an object of the present invention to provide a flow restricting member particularly usable attached to a street storm drain for restricting flow into a curb inlet opening therein which firmly secures a face plate over the curb inlet opening utilizing tamperproof securement bolts.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
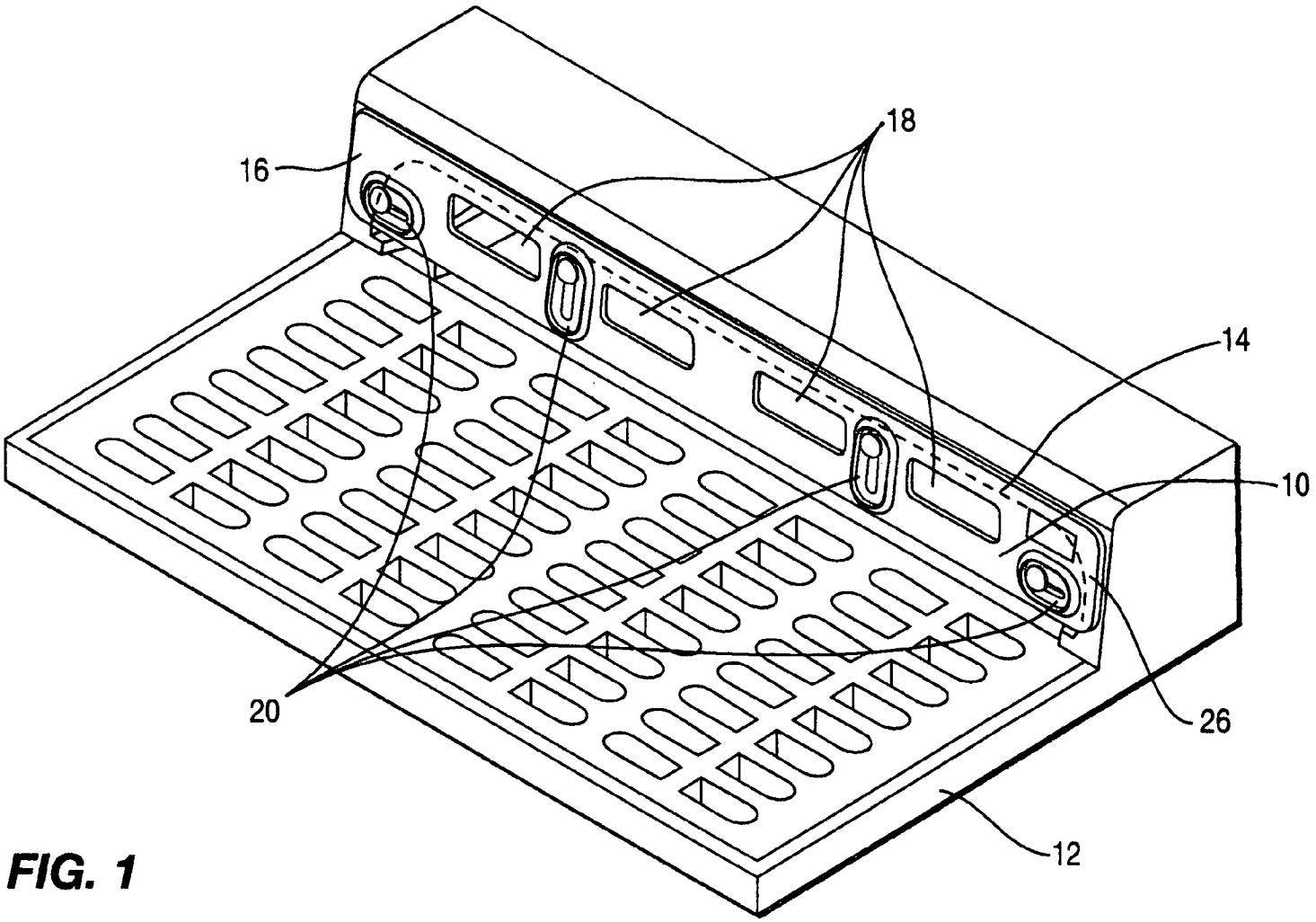
FIG. 1 is a perspective illustration showing the face plate only configuration of the present invention attached with respect to a street storm drain showing a curb inlet opening in dotted outline.
Figure 2:
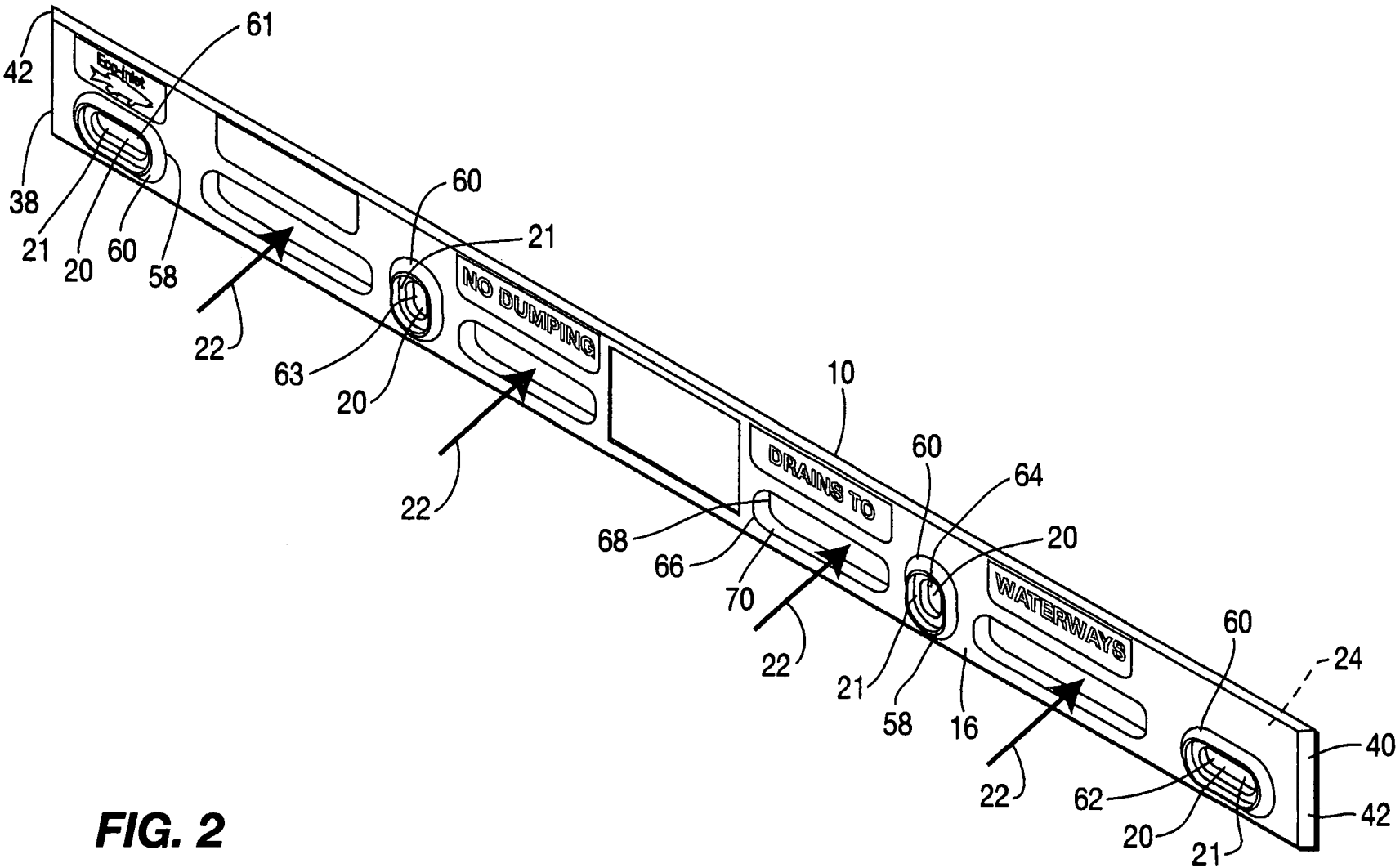
FIG. 2 is a front perspective illustration of an embodiment of a face plate made in accordance with the present invention.

The present invention provides a flow restricting member 10 which is detachably securable with respect to a street storm drain 12, in particular extending over a curb inlet opening 14 defined in drain 12.

Such curb inlet openings 14 are common in curbs of streets and roads in order to receive or gather excessive amounts of water to prevent accumulation thereof upon the roadways. Such storm drains 12 gather this excess water for the purpose of maintaining the roads and highways in an operable condition. However, access into the street storm drain 12 through the curb inlet opening 14 has become problematical in recent years. The large size of the curb inlet opening 14 allows bottles and other trash as well as toys and even individuals to gain entry into the street storm drain 12. This has created a dangerous condition and for this reason a current movement is ongoing to reduce the size of the openings in the curb inlet opening 14 to prevent unwanted entry thereinto. For this reason the present invention provides a unique design for the attachment of a flow restricting member 10 to the street storm drain 12 extending over the curb inlet opening 14.

For this purpose the flow restricting member 10 includes a face plate 16 which is securable to the street storm drain 12 in a position extending over the curb inlet opening 14. Face plate 16 defines a plurality of flow apertures 18 of restricted size to limit access or flow through the curb inlet opening 14 into the storm drain 12. Preferably these openings are less than two inches in vertical dimension. The face plate 16 need not extend over the complete portion of the curb inlet opening 14 as long as it is close enough to the lower portion of the drain 12 to define the vertical distance between the lowermost edge of the face plate 16 and the bottom edge of the curb inlet opening 14 to be less than the desired dimension which is normally approximately two inches.

The face plate 16 will not only define the flow aperture 18 for allowing flow therethrough but also securement apertures 20 for facilitating securement of the face plate 16 and the flow restricting member 10 with respect to the street storm drain 12. Normally these securement apertures 20 in this embodiment will be formed as securement slots 21. As shown in the figures of the present invention the restricted flow path 22 shows the manner in which water and other liquids can pass through the flow apertures 18 defined in the face plate 16 to allow movement thereof into drain 12.

Each face plate 16 will include a rear surface 24 positioned facing toward the street storm drain 12 and a front surface 26 facing away from the street storm drain 12.

A mounting apparatus 28 will be utilized to secure the flow restricting member 10 with respect to the drain 12. This mounting apparatus 28 will include at least one mounting bracket 30 which can be positioned behind the face plate 16. Mounting bracket 30 will define a securement section 32 designed to be positioned behind the storm drain 12 to facilitate the defining of a retaining zone 34 between securement section 32 and the rear surface 24 of face plate 16. In this manner the retaining zone 34 will provide the means of gripping of the street storm drain 12 along the edge of the curb inlet opening 14 thereof between the securement section 32 of the mounting bracket 30 and the rear surface 24 of the face plate 16 and in this manner firmly secure the face plate 16 with respect to the storm drain 12 extending over the curb inlet opening 14.

An engagement means 36 will be provided for the purpose of securing these parts together. This engagement means 36 preferably will include a threaded hole 47 defined in the mounting bracket 30 and a threaded stud member 48. With threaded stud member 48 extending through the securement slot 21 and into the threaded hole 47 of the mounting bracket 30, then tightening of the threaded stud member 48 will cause the securement section 32 of the mounting bracket 30 and the rear surface 24 of the face plate 16 to move toward one another thereby reducing the depth of the retaining zone 34 such that the edge of the storm drain 12 surrounding the curb inlet opening 14 can be firmly and snugly secured thereby. In this manner the flow restricting member 10 will be mounted to the street storm drain 12 in a position extending over the curb inlet opening 14 for restricting flow thereinto.

Each of the mounting brackets 30 can include a guide block 44 therein which is adapted to extend into the securement slot 21 from the rear surface 24 of the face plate 16 to maintain rotational orientation of the mounting bracket 30 with respect to face plate 12. To achieve this purpose the guide block 44 will be movable along and within the securement slot 21. Preferably the guide block 44 includes a first pair of guide surfaces 45 extending generally parallel and oppositely located with respect to one another on the guide block. To further facilitate universal usage of the mounting brackets 30 which include guide blocks 44 a second pair of guide surfaces 46 can be included parallel with respect to one another and oriented perpendicularly with respect to the first pair of guide surfaces 45. In this manner the mounting brackets 30 with the two pairs of guide surfaces 45 and 46 included on the guide block 44 will allow a single design of a mounting bracket 30 to be utilized whether extending in the horizontal or vertical direction. In a more preferred embodiment of the present invention four securement slots will be included, namely, first securement slot 61, second securement slot 62, third securement slot 63 and fourth securement slot 64. The first and second securement slots 61 and 62 will be positioned in the outermost portions of the face plate 16 and will be oriented generally in a horizontally extending direction. The third and fourth securement slots 63 and 64 will be positioned between the first and second securement slots 61 and 62 and will normally be oriented in a vertically extending direction. A similarly constructed mounting bracket 30 can be used in each of these two different orientations by the inclusion of pairs of guide surfaces 45 and 46 on a guide block 44 included thereon.

The construction of the mounting bracket 30 is an important characteristic of the present invention. Each mounting bracket 40 will include a first abutment surface 50 adapted to engage a second abutment surface 52 defined on the rear surface 24 of face plate 16. When the first abutment surface 50 and the second abutment surface 52 are in engaging abutment with respect to one another the mounting bracket 30 will be constructed such that the securement section 32 thereof will be spaced from the rear surface 24 of the face plate 16 to define the retaining zone 34 therebetween for holding of the portion of the street storm drain 12 immediately surrounding the curb inlet opening 14 thereof. To facilitate engagement between the first and second abutment surfaces 50 and 52 preferably first engaging teeth 54 will be defined on the first abutment surface 50 and second engaging teeth 55 will be defined on the second abutment surface 52. First engaging teeth 54 and second engaging teeth 55 will preferably be of a mated or complementary design to facilitate engagement therebetween for affixing of the first abutment surface and second abutment surface 50 and 52 with respect to one another responsive to tightening of the engagement means 36 of the present invention.

Preferably each mounting bracket 30 will also define drain engaging teeth 56. These teeth will be positioned on the securement section 32 of the mounting bracket 30 such that they will facilitate engagement of the securement section 32 with respect to the street storm drain 12 for facilitating securement thereof within the retaining zone 34.

A serious problem with respect to apparatus like that shown in the present invention is in the propensity for damaging thereof by vehicles traveling in the street such as snow plows, street sweepers or any other motor vehicle. For this reason it is preferable that the face plate 16 be designed with chamfered edges 42. Most particularly the first lateral edge 38 and the second lateral edge 40 will each be chamfered from the rear surface 24 inwardly toward the front surface 26 such that damage or breakage to the ends, edges or corners of the face plate 16 by snow plows and the like will be minimized.

In a preferred configuration of the present invention a protective rim 58 is positioned on the front surface 26 of each face plate 16. Protective rim 58 will extend outwardly away from the face plate 16 at least partially around each of the securement apertures 20 or slots 21 in such a manner as to protect the securement aperture 20 from damage from the above described street vehicles. Preferably this protective rim will include a bevel 60 extending therearound which will tend to deflect any damaging item away from the engagement means such as a bolt or the like which would be positioned within the securement slot 21 extending therethrough. As such, it can be appreciated that any damage to the engagement means 36 of the present invention could compromise the securement of the flow restricting member 10 with respect to the street storm drain 12. Thus, the inclusion of the protective rims 58 and additionally the bevel portion 60 around the outer surface of the protective rim 58 will give significant protection to a threaded stud member 48 such as a bolt or the like which would be positioned extending through the securement slots 21 into engagement with the mounting brackets 30 behind the rear surface 24 of the face plate 16. By protecting the means of engagement of the flow restricting member 10 with respect to the drain 12, firm securement in position will be maintained despite contact of snow plows or street sweepers with respect to the flow restricting member 10.

It is also important that no breakage of the face plate 16 occur in any manner which might tend to increase the size of the flow apertures 18. For this purpose a flow aperture tapered edge 70 will be included. Each of the flow apertures 18 can be defined as allowing flow between a first flow aperture opening 66 defined in the front surface 26 of the face plate 16 and a second flow aperture opening 68 defined in the rear surface 24 of the face plate 16. By including a flow aperture tapered edge 70 therebetween the actual size of the first flow aperture 66 in the front surface 26 will be somewhat larger than that of the second flow aperture opening 68 in the rear surface 24 of the face plate 16. This will be due primarily to the taper of the flow aperture 18 as it extends from the front surface 26 to the rear surface 24. This angled, chamfered or bevel will urge deflection of hard metal objects such as a snow plow or street sweeper equipment away from the flow restricting member 10 of the present invention to minimize damagingn thereof.

In an alternative configuration of the present invention a plurality of rear surface stiffening members 74 can be positioned on the rear surface 24 of face plate 16 for maintaining planar rigidity of the face plate. The rear surface stiffening ribs or members 74 can be of various configurations. Tabs 75 can also be provided on the rear surface 24 of the face plate 16 to provide correct spacing between the face plate and the storm grate as needed.

Figure 3:
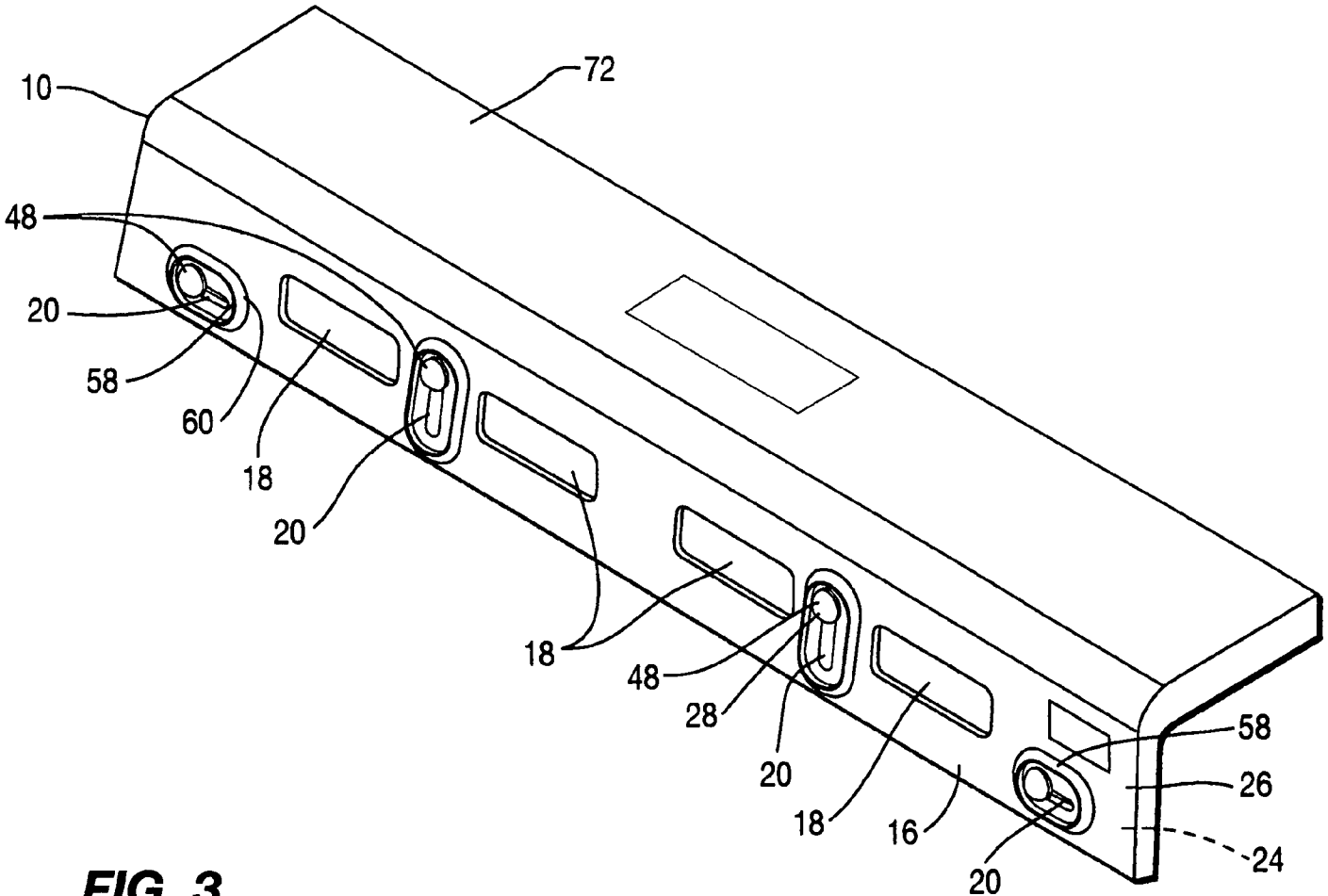
FIG. 3 is a perspective illustration of an embodiment of the full shroud version of the flow restriction member of the present invention.
Figure 4:
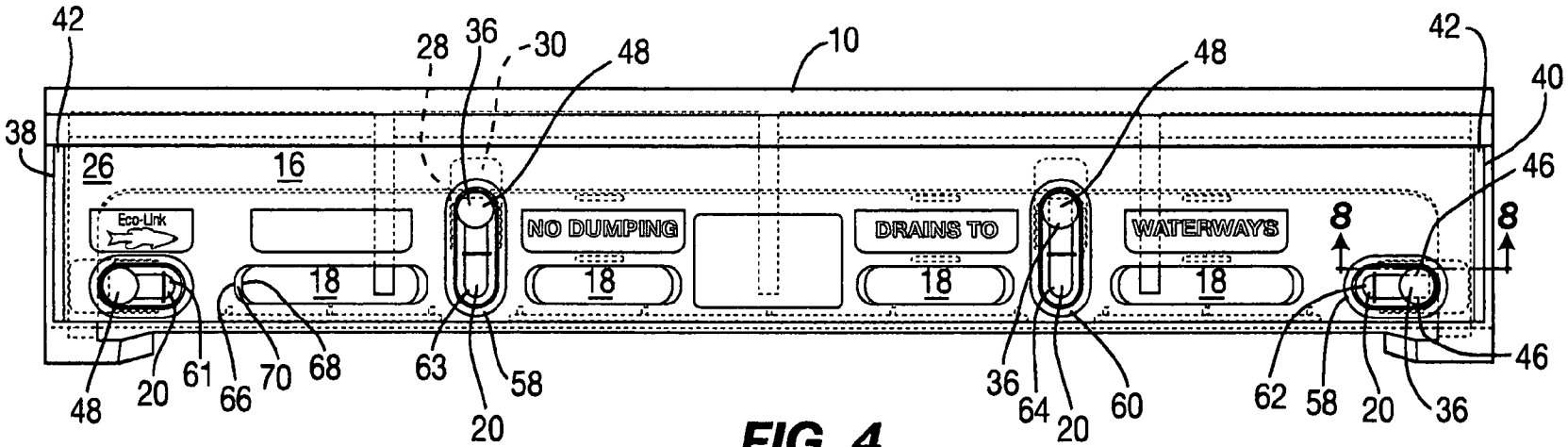
FIG. 4 is a front plan view of an embodiment of the flow restricting member of the present invention shown installed.
Figure 5:
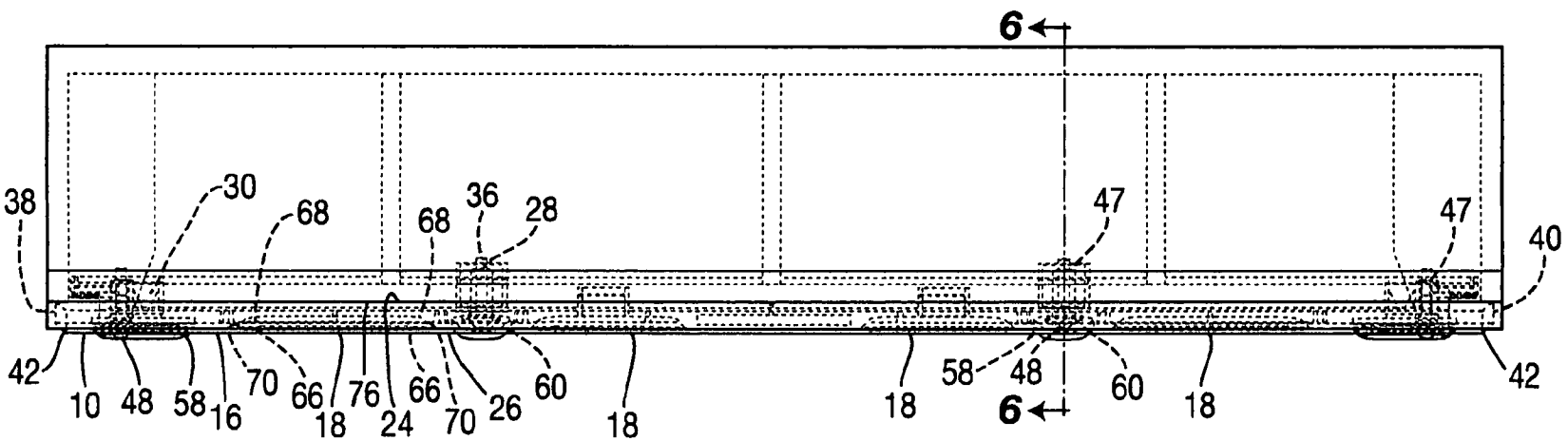
FIG. 5 is a top plan view of the embodiment shown in FIG. 4.
Figure 6:
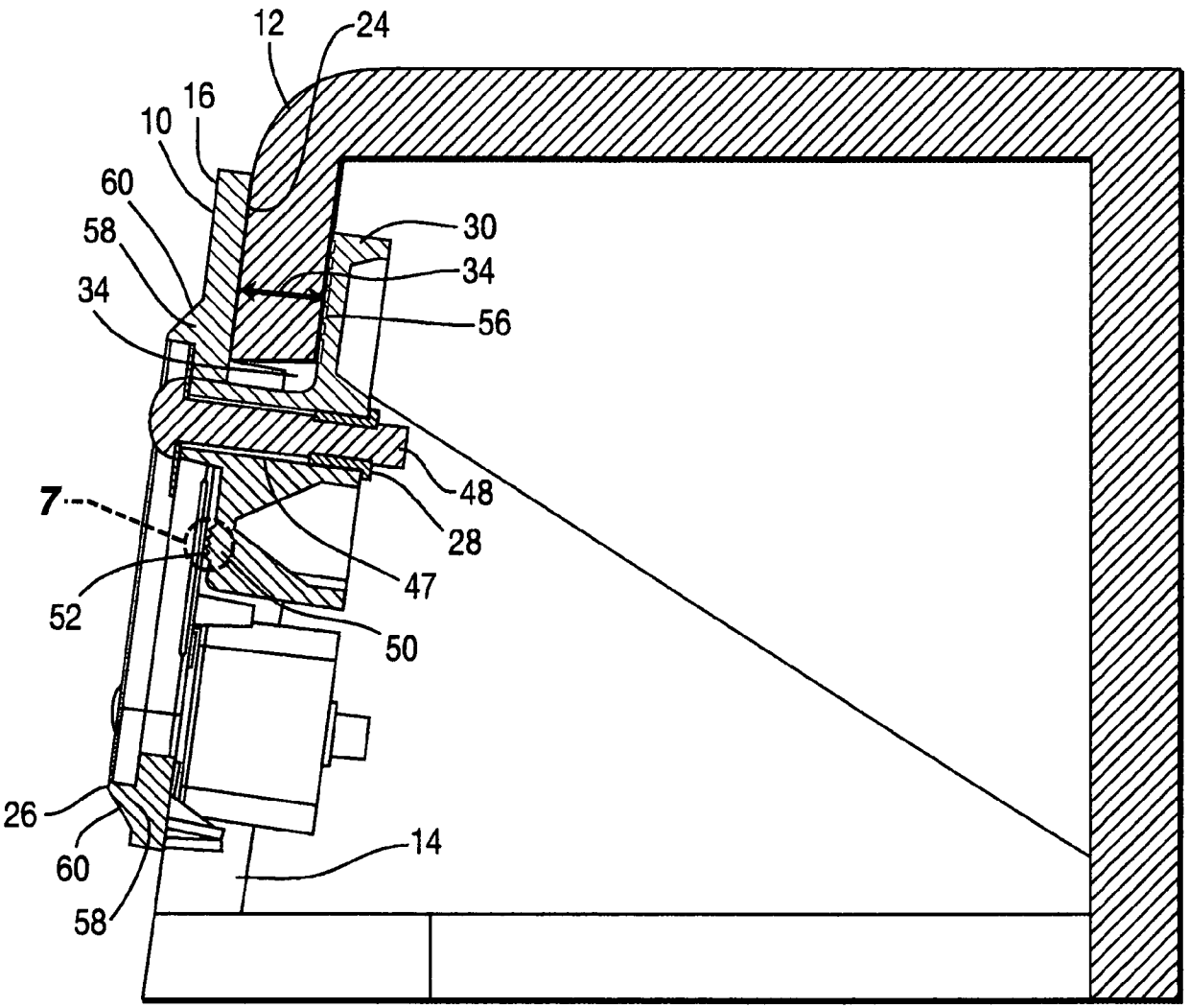
FIG. 6 is a cross-sectional view of FIG. 5 through lines 6—6.
Figure 8:
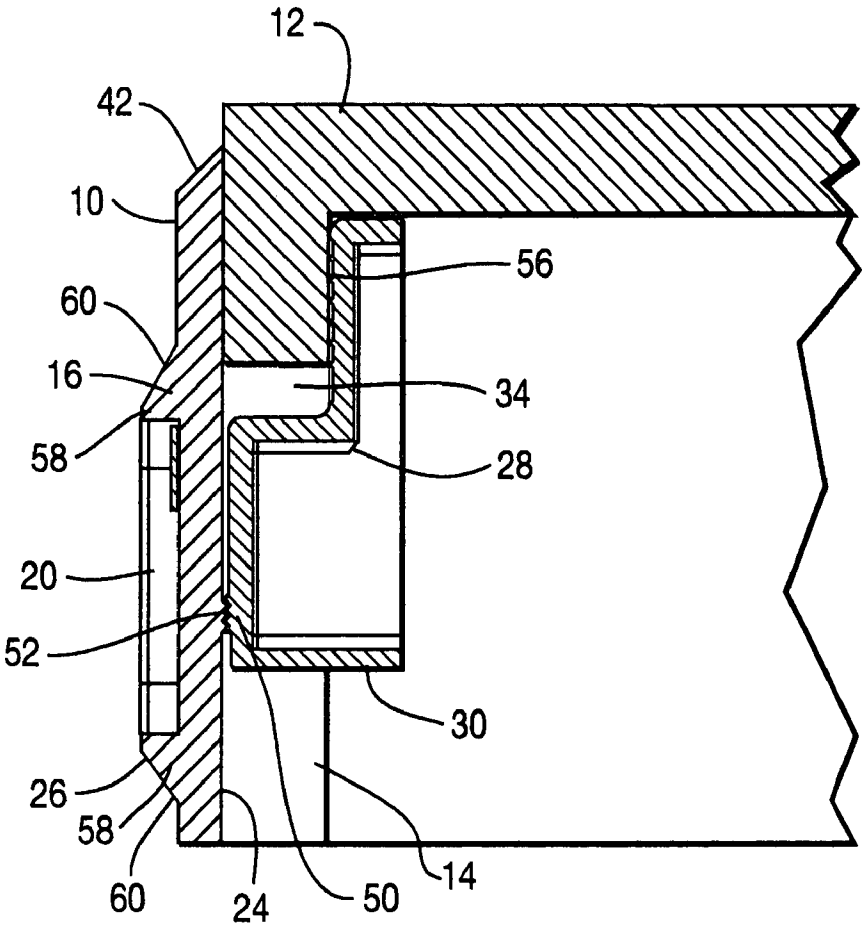
FIG. 8 is a cross-sectional view through line 8—8 of FIG. 4.
Figure 7:
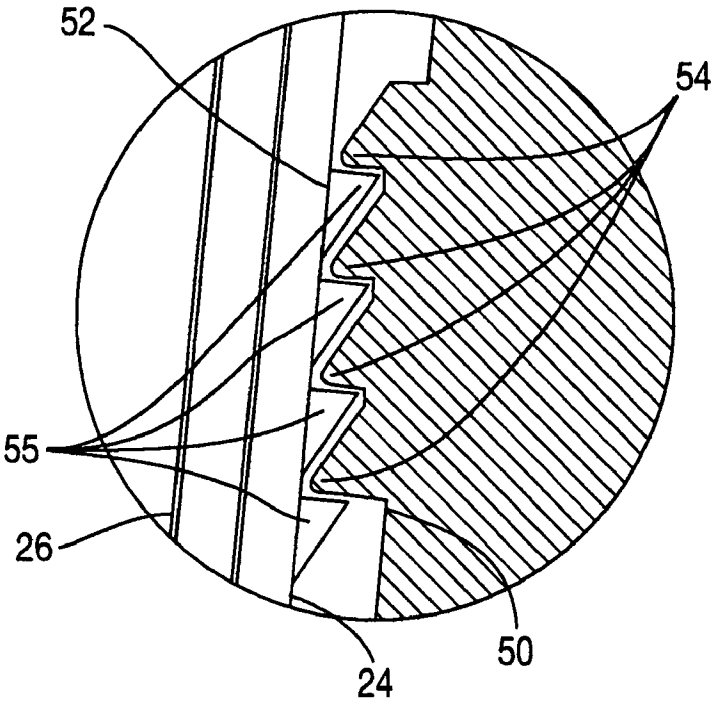
FIG. 7 is an exploded view of section A in FIG. 6.
Figure 9:
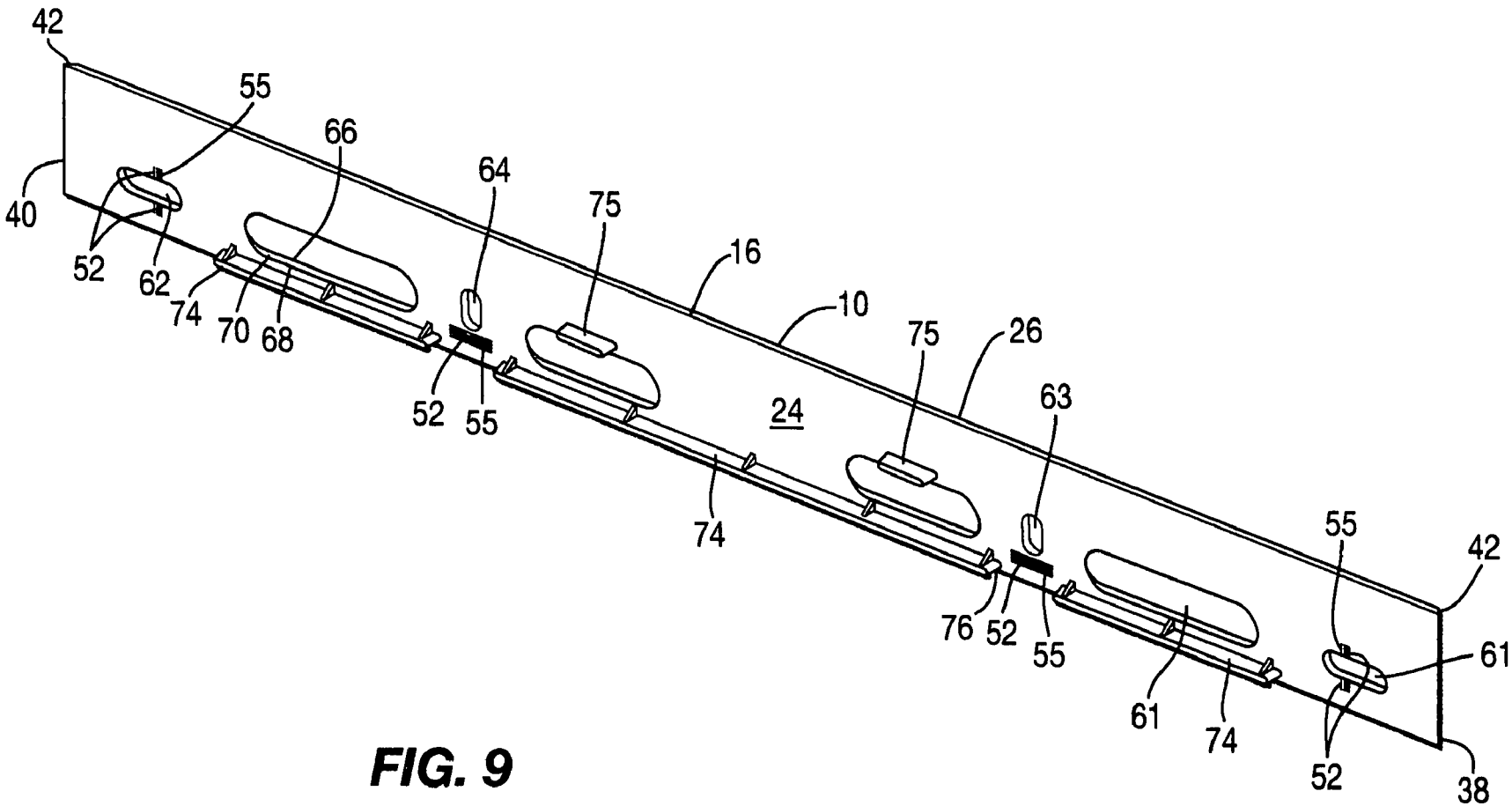
FIG. 9 is a rear perspective view of the illustration shown in FIG. 2.
Figure 10:
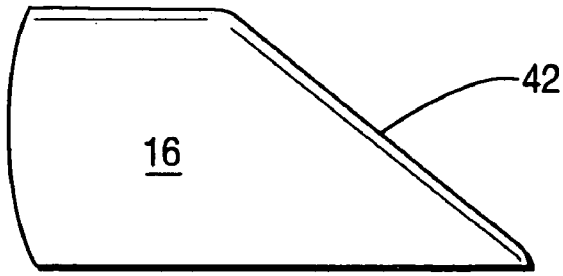
FIG. 10 is a side cross-sectional view of the edges of the face plate showing the chamfered corner.
Figure 11:
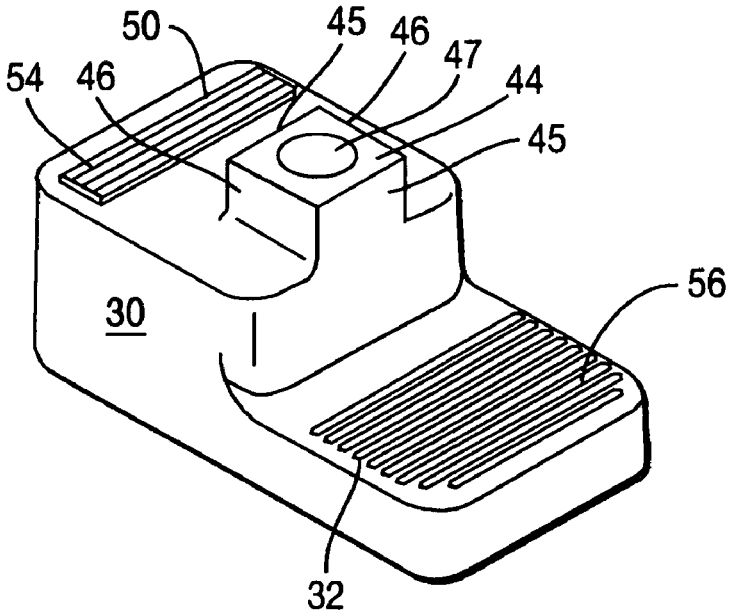
FIG. 11 is a three-quarter perspective illustration of an embodiment of the mounting bracket of the present invention.
Figure 12:
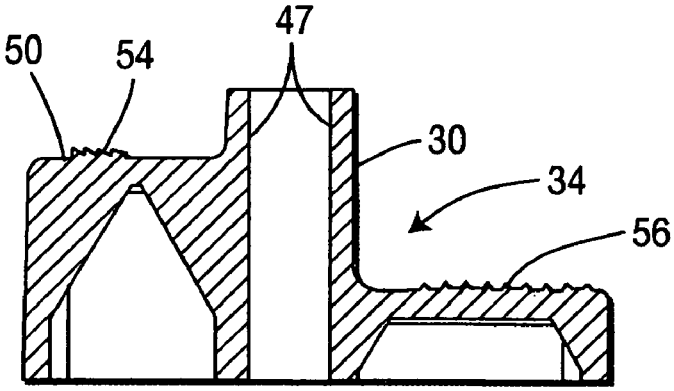
FIG. 12 is a cross-sectional view of an embodiment of a mounting bracket of the present invention.

The present invention can be provided in two basic embodiments one of which includes the face plate 16 apparatus as the full flow restricting member 10. The other includes not only the face plate 16 but also an upper plate member 72. The upper plate member 72 will extend rearwardly from the topmost edge of the face plate 16 at an angle of approximately 90 to 120 degrees with respect thereto. In this manner the upper plate member 72 and the face plate 16 will define a full shroud device enclosing not only the curb inlet opening 14 of the street storm drain 12 but also the upper surface of the drain 12 itself. Such an embodiment is shown in FIG. 3 herein.

The present invention provides a simple and inexpensive and easy to install and reliable debris filtering device which can be used for maximum two inch vertical dimension opening size. It can be installed without any need to remove or replace the existing street storm drain apparatus. In a preferred configuration the securement bolts will comprise tamper resistant bolts thereby further preventing loosening of the attachment between the flow restricting member 10 and the drain 12. Installation and maintenance of the storm water drain cover can be achieved without requiring any removal of any portion of the storm drain 12 itself. Also the apparatus can include slots and mounting locations for placing promotional literature, advertising literature or identification information such as registration, municipality, number or bar code information.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A flow restricting member for attachment to a street storm drain for positioning extending over a curb inlet opening defined therein which comprises:

A. a face plate defining a flow aperture means and a securement aperture means extending therethrough, said flow aperture means providing a restricted flow path through the curb inlet opening, said securement aperture means facilitating attachment of said face plate with respect to the street storm drain adjacent and extending over the curb inlet opening defined therein for restricting flow therethrough, said face plate including:

(1) a rear surface facing the curb inlet opening and the street storm drain responsive to securement of said face plate with respect thereto;

(2) a front surface facing away from the street storm drain and the curb inlet opening responsive to securement of said face plate with respect thereto;

B. a mounting apparatus at least partially positionable extending through said securement aperture means for engagement with respect to the storm drain immediately surrounding the curb inlet opening and engageable with respect to said face plate for retaining thereof in position extending over the curb inlet opening for restricting flow therethrough, said mounting apparatus including:

(1) at least one mounting bracket positionable adjacent to said securement aperture means at a position at least partially behind said rear surface of said face plate, said mounting bracket including a securement section which is spatially disposed from said rear surface of said face plate to define therebetween a retaining zone for receiving and holding the street storm drain therewithin immediately surrounding the curb inlet opening defined therein for securing said face plate with respect thereto; and (2) an engagement means positioned extending through said securement aperture means and engageable with said mounting bracket means for urging thereof toward said rear surface of said face plate with the street storm drain surrounding the curb inlet opening positioned within said retaining zone for securement of said face plate with respect thereto.

2. A flow restricting member for attachment to a street storm drain for positioning extending over a curb inlet opening defined therein as defined in claim 1 wherein said face plate further includes:

A. a first lateral end extending between said rear surface and said front surface of said face plate, said first lateral end being chamfered at an angle from said rear surface to said front surface laterally adjacent said face plate; and B. a second lateral end extending between said rear surface and said front surface of said face plate and positioned oppositely from said first lateral end, said second end edge being chamfered at an angle from said rear surface to said front surface laterally adjacent said face plate, said first lateral end and said second lateral end being chamfered inwardly toward one another extending forwarding from said rear surface of said face plate to said front surface thereof.

3. A flow restricting member for attachment to a street storm drain for positioning extending over a curb inlet opening defined therein as defined in claim 1 wherein said securement aperture means comprises at least one securement slot means to facilitate adjustable positioning of said engagement means therewithin for facilitating adjustably positionable mounting of said face plate with respect to the curb inlet opening defined in the street storm drain.

4. A flow restricting member for attachment to a street storm drain for positioning extending over a curb inlet opening defined therein as defined in claim 3 wherein said mounting bracket includes a guide block extending outwardly therefrom which is positionable extending into said securement slot means to facilitate maintaining of orientation of said mounting bracket with respect to said face plate.

5. A flow restricting member for attachment to a street storm drain for positioning extending over a curb inlet opening defined therein as defined in claim 4 wherein said guide block of said mounting bracket includes an threaded hole means defined extending therethrough and wherein said engagement means includes a threaded stud member which is selectively engageable within said threaded hole means to facilitate attachment of said engagement means with respect to said mounting bracket to retain the street storm drain in said retaining zone for mounting of said face plate in position extending across said curb inlet opening for limiting flow therethrough.

6. A flow restricting member for attachment to a street storm drain for positioning extending over a curb inlet opening defined therein as defined in claim 4 wherein said guide block includes at least one pair of guide surfaces spatially disposed from one another and extending generally parallel to one another which are adapted to properly orient said mounting bracket with respect to said face plate to facilitate mounting thereof to a street storm drain extending over the curb inlet opening defined therein.

7. A flow restricting member for attachment to a street storm drain for positioning extending over a curb inlet opening defined therein as defined in claim 4 wherein each said guide block includes:

A. a first pair of guide surfaces spatially disposed from one another and extending generally parallel to one another which are adapted to properly orient said mounting bracket with respect to said face plate to facilitate mounting thereof to a street storm drain extending over the curb inlet opening defined therein; and B. a second pair of guide surfaces spatially disposed from one another and extending generally parallel to one another which are adapted to properly orient said mounting bracket with respect to said face plate to facilitate mounting thereof to a street storm drain extending over the curb inlet opening defined therein, said second pair of guide surfaces being oriented approximately perpendicularly with respect to said first pair of guide surfaces.

8. A flow restricting member for attachment to a street storm drain for positioning extending over a curb inlet opening defined therein as defined in claim 1 wherein said mounting bracket includes an threaded hole means and wherein said engagement means includes a threaded stud member which is positionable extending through said securement aperture means for engagement within said threaded hole means to facilitate attachment of said engagement means with respect to said mounting bracket to retain the street storm drain in said retaining zone for mounting of said face plate in position extending across said curb inlet opening for limiting flow therethrough.

9. A flow restricting member for attachment to a street storm drain for positioning extending over a curb inlet opening defined therein as defined in claim 1 wherein said mounting bracket defines a first abutment surface thereon and wherein said rear surface of said face plate defines a second abutment surface thereon, said first abutment surface and said second abutment surface adapted to abut and engage one another to facilitate securement of said mounting bracket with respect to said rear surface of said face plate.

10. A flow restricting member for attachment to a street storm drain for positioning extending over a curb inlet opening defined therein as defined in claim 9 wherein said first abutment surface of said mounting bracket includes first engaging teeth thereon to enhance abutment of said second abutment surface therewith.

11. A flow restricting member for attachment to a street storm drain for positioning extending over a curb inlet opening defined therein as defined in claim 10 wherein said second abutment surface defined on said rear surface of said face plate includes second engaging teeth thereon to enhance abutment of said first engaging teeth of said first abutment surface therewith, said first engaging teeth and said second engaging teeth being shaped mutually complementary to facilitate abutting engagement therebetween and between said mounting bracket and said rear surface of said face plate.

12. A flow restricting member for attachment to a street storm drain for positioning extending over a curb inlet opening defined therein as defined in claim 1 wherein said securement section of said mounting bracket includes drain engaging teeth thereon which are adapted to abut and engage a street storm drain to facilitate retaining thereof within said retaining zone.

13. A flow restricting member for attachment to a street storm drain for positioning extending over a curb inlet opening defined therein as defined in claim 1 further comprising at least one protective rim means positioned on said front surface of said face plate and extending outwardly therefrom, each of said protective rim means positioned at least partially surrounding one of said securement aperture means for protecting thereof.

14. A flow restricting member for attachment to a street storm drain for positioning extending over a curb inlet opening defined therein as defined in claim 13 wherein each of said protective rim means defines an outer rim edge extending outwardly away from said front surface of said face plate to form a bevel on said outer rim edge for further protection of said securement aperture means thereadjacent.

15. A flow restricting member for attachment to a street storm drain for positioning extending over a curb inlet opening defined therein as defined in claim 13 wherein said engagement means is positionable within said securement aperture means at a position below said protective rim means extending therearound for facilitating protecting thereof.

16. A flow restricting member for attachment to a street storm drain for positioning extending over a curb inlet opening defined therein as defined in claim 1 wherein said securement aperture means includes:

A. a first securement slot defined extending horizontally in said face plate;

B. a second securement slot defined extending horizontally in said face plate and spatially disposed from said first securement slot;

C. a third securement slot defined extending vertically in said face plate at a position spatially disposed from said first securement slot and said second securement slot and positioned therebetween; and D. a fourth securement slot defined extending vertically in said face plate at a position spatially disposed from said first securement slot, said second securement slot and said third securement slot and positioned between said third securement slot and said second securement slot.

17. A flow restricting member for attachment to a street storm drain for positioning extending over a curb inlet opening defined therein as defined in claim 1 wherein each of said flow aperture means defines a first flow aperture opening in said front surface of said face plate and wherein each of said flow aperture means defines a second flow aperture opening in said rear surface of said face plate, and wherein said flow aperture means is tapered inwardly toward said rear surface of said face plate such that said first flow aperture is larger than said second flow aperture to facilitate protection of said face plate.

18. A flow restricting member for attachment to a street storm drain for positioning extending over a curb inlet opening defined therein as defined in claim 1 further comprising an upper plate member secured to said face plate and extending rearwardly away therefrom at an angle of between 90 degrees and 120 degrees to extend over and above the street storm drain n a generally horizontal direction.

19. A flow restricting member for attachment to a street storm drain for positioning extending over a curb inlet opening defined therein as defined in claim 1 further including a tab means secured to the rear surface of the face plate and extending outwardly therefrom to provide spacing between the face plate and the street storm drain.

20. A flow restricting member for attachment to a street storm drain for positioning extending over a curb inlet opening defined therein as defined in claim 1 wherein said securement aperture means defined in said face plate comprises a plurality of individual securement apertures defined therein with at least one of said mounting brackets being positionable adjacent to each of said securement apertures at a position at least partially behind said rear surface of said face plate.

21. A flow restricting member for attachment to a street storm drain for positioning extending over a curb inlet opening defined therein as defined in claim 1 wherein said retaining zone defined between said securement section of each of said mounting brackets and said rear surface of said face plate is adapted to receive and hold the portion of the street storm drain immediately surrounding and defining the curb inlet opening defined therein.

22. A flow restricting member for attachment to a street storm drain for positioning extending over a curb inlet opening defined therein as defined in claim 1 wherein said front surface of said face plate is positioned facing approximately oppositely from said rear surface thereof.

23. A flow restricting member for attachment to a street storm drain for positioning extending over a curb inlet opening defined therein as defined in claim 1 wherein said engagement means includes a threaded stud member which facilitates engagement thereof with respect to said mounting bracket to retain the street storm drain within said retaining zone for mounting of said face plate in position extending across said curb inlet opening for limiting flow therethrough.

24. A flow restricting member for attachment to a street storm drain for positioning extending over a curb inlet opening defined therein which comprises:

A. a face plate defining at least one flow aperture means and a plurality of securement aperture means extending therethrough, each of said securement aperture means including a securement slot means to facilitate adjustment, each of said flow aperture means defining a first flow aperture opening in said front surface of said face plate and a second flow aperture opening in said rear surface of said face plate in fluid flow communication with respect to one another, and wherein said flow aperture means is tapered inwardly toward said rear surface of said face plate such that said first flow aperture is larger than said second flow aperture to facilitate protection of said face plate, said flow aperture means providing a restricted flow path through the curb inlet opening, said securement aperture means facilitating attachment of said face plate with respect to the street storm drain adjacent the curb inlet opening defined therein, said face plate including:

(1) a rear surface facing the curb inlet opening and the street storm drain responsive to securement of said face plate with respect thereto;

(2) a front surface positioned oppositely from said rear surface and facing away from the street storm drain and the curb inlet opening responsive to securement of said face plate with respect thereto;

(3) a first lateral end extending between said rear surface and said front surface of said face plate, said first lateral end being chamfered at an angle from said rear surface to said front surface laterally adjacent said face plate;

(4) a second lateral end extending between said rear surface and said front surface of said face plate and positioned oppositely from said first lateral end, said second end edge being chamfered at an angle from said rear surface to said front surface laterally adjacent said face plate, said first lateral end and said second lateral end being chamfered inwardly toward one another extending forwarding from said rear surface of said face plate to said front surface thereof;

B. a mounting apparatus at least partially positionable extending through said securement aperture means for engagement with respect to the storm drain immediately surrounding the curb inlet opening and engageable with respect to said face plate for retaining thereof in position extending over the curb inlet opening for restricting flow therethrough, said mounting apparatus including:

(1) at least one mounting bracket positionable adjacent to each of said securement aperture means at a position at least partially behind said rear surface of said face plate, said mounting bracket including a securement section which is spatially disposed from said rear surface of said face plate to define therebetween a retaining zone for receiving and holding the street storm drain therewithin immediately surrounding the curb inlet opening defined therein for securing said face plate with respect thereto, said mounting bracket defining a threaded hole means therein, said mounting bracket defining a first abutment surface thereon and said rear surface of said face plate defining a second abutment surface thereon, said first abutment surface and said second abutment surface adapted to abut and engage one another to facilitate securement of said mounting bracket with respect to said rear surface of said face plate;

(2) an engagement means positioned extending through said securement aperture means and engageable with said mounting bracket means for urging thereof toward said rear surface of said face plate with the street storm drain surrounding the curb inlet opening positioned within said retaining zone for securement of said face plate with respect thereto, said engagement means including a threaded stud member which is positionable extending through said securement aperture means for engagement within said threaded hole means thereof to facilitate attachment of said engagement means with respect to said mounting bracket to retain the street storm drain in said retaining zone for mounting of said face plate in position extending across said curb inlet opening for limiting flow therethrough; and C. a plurality of protective rim means positioned on said front surface of said face plate and extending outwardly therefrom, each of said protective rim means positioned at least partially surrounding one of said securement aperture means for protecting thereof, each of said protective rim means defining an outer rim edge extending outwardly away from said front surface of said face plate to form a bevel on said outer rim edge for further protection of said securement aperture means thereadjacent.

25. A flow restricting member for attachment to a street storm drain for positioning extending over a curb inlet opening defined therein which comprises:

A. a face plate defining at least one flow aperture means and a plurality of securement aperture means extending therethrough, each of said securement aperture means including a securement slot means to facilitate adjustment, each of said flow aperture means defining a first flow aperture opening in said front surface of said face plate and a second flow aperture opening in said rear surface of said face plate in fluid flow communication with respect to one another, and wherein said flow aperture means is tapered inwardly toward said rear surface of said face plate such that said first flow aperture is larger than said second flow aperture to facilitate protection of said face plate, said flow aperture means providing a restricted flow path through the curb inlet opening, said securement aperture means facilitating attachment of said face plate with respect to the street storm drain adjacent the curb inlet opening defined therein, said face plate including:

(1) a rear surface facing the curb inlet opening and the street storm drain responsive to securement of said face plate with respect thereto;

(2) a front surface positioned oppositely from said rear surface and facing away from the street storm drain and the curb inlet opening responsive to securement of said face plate with respect thereto;

(3) a first lateral end extending between said rear surface and said front surface of said face plate, said first lateral end being chamfered at an angle from said rear surface to said front surface laterally adjacent said face plate;

(4) a second lateral end extending between said rear surface and said front surface of said face plate and positioned oppositely from said first lateral end, said second end edge being chamfered at an angle from said rear surface to said front surface laterally adjacent said face plate, said first lateral end and said second lateral end being chamfered inwardly toward one another extending forwarding from said rear surface of said face plate to said front surface thereof;

B. a mounting apparatus at least partially positionable extending through said securement aperture means for engagement with respect to the storm drain immediately surrounding the curb inlet opening and engageable with respect to said face plate for retaining thereof in position extending over the curb inlet opening for restricting flow therethrough, said mounting apparatus including:

(1) at least one mounting bracket positionable adjacent to each of said securement aperture means at a position at least partially behind said rear surface of said face plate, said mounting bracket including a securement section which is spatially disposed from said rear surface of said face plate to define therebetween a retaining zone for receiving and holding the street storm drain therewithin immediately surrounding the curb inlet opening defined therein for securing said face plate with respect thereto, said mounting bracket defining a threaded hole means therein, said mounting bracket defining a first abutment surface thereon and said rear surface of said face plate defining a second abutment surface thereon, said first abutment surface and said second abutment surface adapted to abut and engage one another to facilitate securement of said mounting bracket with respect to said rear surface of said face plate, said mounting bracket including a guide block extending outwardly therefrom which is positionable extending into said securement slot means to facilitate maintaining of orientation of said mounting bracket with respect to said face plate, said guide block including a threaded hole means defined extending therethrough, each said guide block including a first pair of guide surfaces spatially disposed from one another and extending generally parallel to one another which are adapted to properly orient said mounting bracket with respect to said face plate to facilitate mounting thereof to a street storm drain extending over the curb inlet opening defined therein and a second pair of guide surfaces spatially disposed from one another and extending generally parallel to one another which are adapted to properly orient said mounting bracket with respect to said face plate to facilitate mounting thereof to a street storm drain extending over the curb inlet opening defined therein, said second pair of guide surfaces being oriented approximately perpendicularly with respect to said first pair of guide surfaces, said first abutment surface of said mounting bracket including first engaging teeth thereon to enhance abutment of said second abutment surface therewith, said second abutment surface defined on said rear surface of said face plate including second engaging teeth thereon to enhance abutment of said first engaging teeth of said first abutment surface therewith, said first engaging teeth and said second engaging teeth being shaped mutually complementary to facilitate abutting engagement therebetween and between said mounting bracket and said rear surface of said face plate, said securement section of said mounting bracket including drain engaging teeth thereon which are adapted to abut and engage a street storm drain to facilitate retaining thereof within said retaining zone;

(2) an engagement means positioned extending through said securement aperture means and engageable with said mounting bracket means for urging thereof toward said rear surface of said face plate with the street storm drain surrounding the curb inlet opening positioned within said retaining zone for securement of said face plate with respect thereto, said engagement means including a threaded stud member which is selectively engageable within said threaded hole means to facilitate attachment of said engagement means with respect to said mounting bracket to retain the street storm drain in said retaining zone for mounting of said face plate in position extending across said curb inlet opening for limiting flow therethrough; and C. a plurality of protective rim means positioned on said front surface of said face plate and extending outwardly therefrom, each of said protective rim means positioned at least partially surrounding one of said securement aperture means for protecting thereof, each of said protective rim means defining an outer rim edge extending outwardly away from said front surface of said face plate to form a bevel on said outer rim edge for further protection of said securement aperture means thereadjacent, said engagement means being positioned within said securement aperture means at a position below said protective rim means extending therearound for further facilitating protecting thereof.

* * * * *